US005970665A

United States Patent [19]

Oudman

[11] Patent Number: 5,970,665

[45] Date of Patent: Oct. 26, 1999

[54] SYSTEM AND METHOD FOR MAINTAINING A BUILDING A STRUCTURE IN A LEVEL CONDITION

[76] Inventor: Jack A. Oudman, 7532 Mt. Zirkel, Littleton, Colo. 80127

[21] Appl. No.: 08/941,854

[22] Filed: Sep. 30, 1997

Related U.S. Application Data

[60] Provisional application No. 60/027,291, Oct. 2, 1996.

[51] Int. Cl.[6] ..... E04B 5/00; E02D 27/00; E02D 27/32

[52] U.S. Cl. ..... 52/126.6; 52/126.1; 52/1; 52/293.3; 254/13

[58] Field of Search ..... 52/105, 126.1, 52/126.5, 126.6, 126.7, 263, 293.3, 741.1, 750, 1; 254/13, 92

[56] References Cited

U.S. PATENT DOCUMENTS

| | | | |
|---|---|---|---|
| 2,138,958 | 12/1938 | Corbett et al. | 52/126.6 X |
| 2,942,848 | 6/1960 | Friesen . | |
| 3,096,591 | 7/1963 | Higgins et al. . | |
| 3,396,944 | 8/1968 | Jansz . | |
| 3,564,786 | 2/1971 | Baker | 52/126.7 X |
| 3,849,898 | 11/1974 | Turloff | 33/367 |
| 4,041,613 | 8/1977 | Bishop | 33/367 |
| 4,169,320 | 10/1979 | Bennett | 33/367 |
| 4,192,623 | 3/1980 | Borg . | |
| 4,404,780 | 9/1983 | Josephson . | |
| 4,870,789 | 10/1989 | Clark et al. . | |
| 4,930,750 | 6/1990 | De Castro . | |
| 4,937,989 | 7/1990 | Miyares et al. | 52/126.6 X |
| 5,065,844 | 11/1991 | Hon . | |

*Primary Examiner*—Robert Canfield
*Attorney, Agent, or Firm*—Brian D. Smith, P.C.

[57] ABSTRACT

A system for supporting and maintaining the upper portion of a building structure in a level condition includes a vertically adjustable load-bearing assembly including a plurality of spaced support jacks supporting the upper portion above a lower portion of the building structure, the support jacks being adjustable vertically in height independent of the other in order to maintain the upper portion in a level condition, and a plurality of level indicators fixed relative to the upper portion that cooperate with each other to indicate whether the upper portion is level. A method of keeping an upper portion of a building structure level includes the steps of installing a vertically adjustable load-bearing assembly including a plurality of spaced support jacks for supporting the upper portion of the building structure above the lower portion thereof with each support jack being adjustable vertically in height independent of the other, fixing a plurality of level indicators relative to the upper portion such that the indicators cooperate with each other to indicate whether the upper portion is level, and adjusting the height of the support jacks until the indicators indicate that the upper portion is level.

9 Claims, 4 Drawing Sheets

SYSTEM AND METHOD FOR MAINTAINING A BUILDING A STRUCTURE IN A LEVEL CONDITION

CROSS REFERENCE TO RELATED APPLICATIONS

This application is a nonprovisional application claiming the benefit under 35 USC 119(e) of U.S. provisional application Ser. No. 60/027,291, filed on Oct. 2, 1996.

TECHNICAL FIELD

The present invention generally relates to the construction of buildings and, more particularly, is concerned with a system and a method for supporting and maintaining a building structure in a level condition.

BACKGROUND OF THE INVENTION

Many building structures, particularly residential homes, include an upper portion that overlies and is supported upon a lower portion. The upper portion may include, for example, one or more floors, several load-bearing walls, and a roof. The lower portion is often a foundation that is substantially below ground. Sometimes the foundation is in turn supported upon a plurality of caissons that extend below the foundation. In this situation, the floors, load-bearing walls, roof and foundation can be considered the upper portion of the building structure and the caissons the lower portion.

Regardless of the situation, expansive soils, such as Bentonite, can cause movement of the foundation that in turn can cause the upper portion of the building to tilt. When the upper portion tilts from a level condition, substantial structural damage can occur. For example, tilting of the upper portion can result in rising or falling floors, cracked ceilings and walls, and other damage. Such damage can be avoided by supporting and maintaining the upper portion of the building structure in a level condition.

The upper portion may be maintained in a level condition through the use of support jacks that support the upper portion over the lower portion and which are individually adjustable in height. However, an indication of whether the upper portion is level is necessary in order to determine if the support jacks are properly adjusted. Consequently, a need exists for a system and method for supporting and maintaining the upper portion of a building structure in a level condition that combines adjustable support jacks with indicators that indicate whether the upper portion is level.

While a system and method that meets the above need is sufficient, there are two drawbacks associated with using support jacks to keep the upper portion level. First, if one or more of the support jacks moves in a lateral direction, the effectiveness of the system and method can be compromised. Thus, restricting lateral movement of the support jacks is desirable. Second, because the support jacks apply force to the upper portion at specific locations, the upper portion may sag between the support jacks resulting in the same type of structural damage caused by tilting of the upper portion. Consequently, it is also desirable to rigidify the upper portion to minimize sagging between the support jacks.

One further drawback associated with using support jacks to keep the upper portion level is that the support jacks need to be adjusted as the foundation moves in order to keep the upper portion level. While it is possible to adjust the support jacks by eye, doing so can be cumbersome and difficult, particularly where there are numerous support jacks or the foundation moves often. Also, if the upper portion tilts enough between adjustments, structural damage may result before the upper portion is returned to level. For these reasons, it would be desirable if it were possible to easily adjust, preferably automatically adjust, the height of the support jacks so that the upper portion is easily returned to a level condition or better yet maintained level at all times.

DISCLOSURE OF THE INVENTION

One object of the present invention is to provide a system for supporting and maintaining the upper portion of a building structure in a level condition. In its broadest sense the system includes a vertically adjustable load-bearing assembly having a plurality of support jacks that support an upper portion of a building structure above a lower portion and which are individually vertically adjustable. In addition, the system includes a plurality of level indicators fixed relative to the upper portion that cooperate with each other to indicate whether the upper portion is level.

A second object of the present invention is to provide a system wherein lateral movement of the support jacks is restricted. Thus, the system of the present invention may further include, as part of the load-bearing assembly, means for restricting lateral movement of the support jacks.

A third object of the present invention is to provide a system that minimizes sagging of the upper portion between the support jacks. To achieve this, the system of the present invention may also include, as part of the load-bearing assembly, rigidifying means for minimizing sagging of the upper portion.

A fourth object of the present invention is to provide a system wherein the building structure is automatically kept level. This is achieved by including in the system control means for automatically adjusting the vertical height of the support jacks in response to input from the indicators.

A further object of the present invention is to provide a method of keeping the upper portion of a building structure level. In its broadest sense, the method includes the following steps: (a) installing a vertically adjustable load-bearing assembly including a plurality of spaced support jacks for supporting the upper portion of the building structure above a lower portion with the support jacks being individually and vertically adjustable; (b) fixing a plurality of level indicators relative to the upper portion such that the indicators cooperate with each other to indicate whether the upper portion is level; and (c) adjusting the height of the support jacks until the indicators indicate that the upper portion is level.

A still further object of the present invention is to provide a method whereby the potential for structural damage to the upper portion caused by sagging between the support jacks is reduced or eliminated. To meet this objective, the method of the present invention may also include the further step of rigidifying the load-bearing assembly.

An additional object of the present invention is to provide a method wherein the upper portion of the building structure is kept level even though the foundation occasionally moves. Thus, the method of the present invention may further include the steps of periodically checking the indicators to determine whether the upper portion is level and manually adjusting the height of the support jacks as needed to keep the upper portion level. Alternatively, the method of the present invention may include the further step of automatically adjusting the vertical height of the support jacks by means of a controller responsive to input from the indicators.

These and other features of the present invention will become apparent to those skilled in the art upon a reading of the following detailed description when taken in conjunction with the drawings wherein there is shown and described several illustrative embodiments of the invention.

BRIEF DESCRIPTION OF THE DRAWINGS

In the following detailed description, reference will be made to the attached drawings in which.

BEST MODE FOR CARRYING OUT THE INVENTION

Referring to FIGS. 1–8, a system of the present invention, generally designated by the numeral 10, is incorporated in a building structure B having an upper portion U and a lower portion L. Although the system of the present invention 10 may be incorporated into any building structure B having upper and lower portions U, L, building structure B as shown is that of a typical residential home. The upper portion U includes several exterior load-bearing walls UW, a floor F, and floor joists J. The lower portion comprises a foundation F having upright foundation walls FW that correspond with and underlie the load-bearing walls UW of the upper portion U. The foundation F is substantially below the ground G. System 10 supports and maintains the upper portion U of the building structure B in a level condition.

Figure 4:
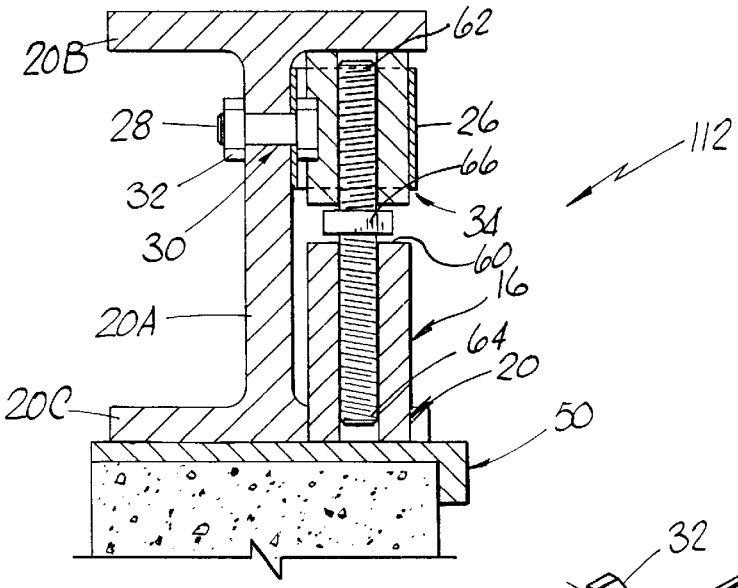
FIG. 4 is a vertical cross-sectional view of the first embodiment of the load-bearing assembly wherein lateral movement of a support jack of the load-bearing assembly is restricted by means of a U-shaped bracket.
Figure 7:
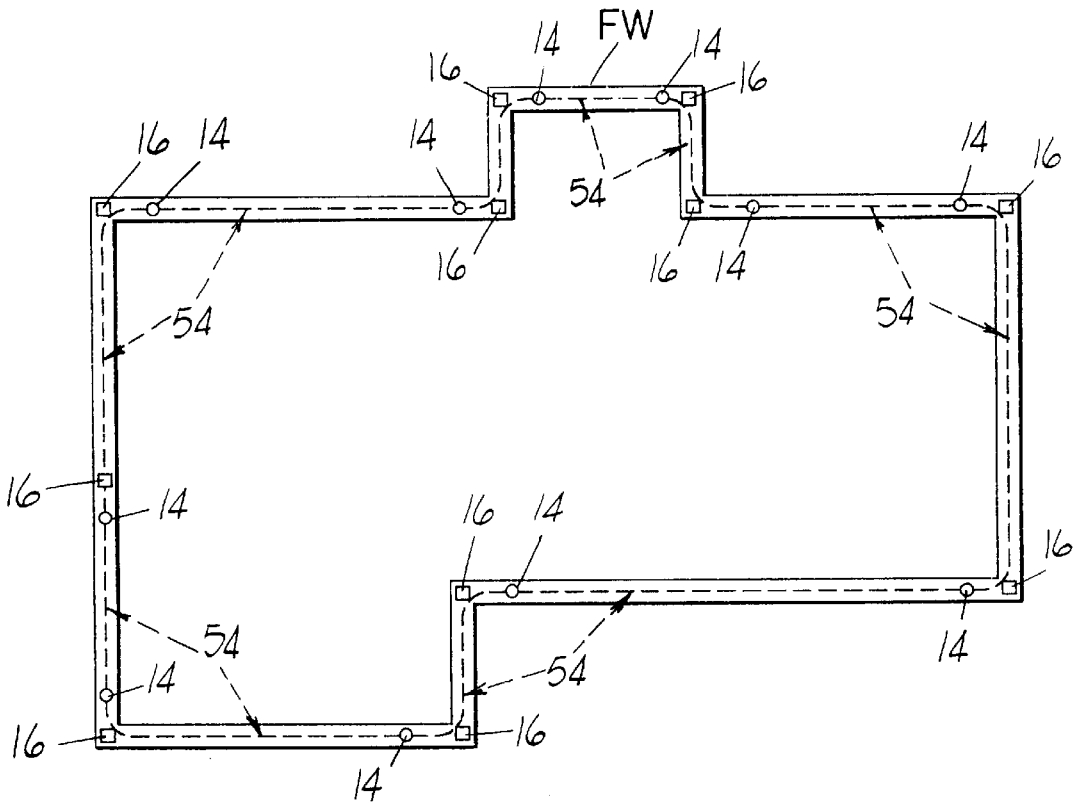
FIG. 7 is a schematic view showing the location of the support jacks and indicators of the system of the present invention on the upper ends of the foundation walls of the building structure.

As shown, system 10 includes a load-bearing assembly, generally designated by the numeral 12, and a plurality of indicators 14. The indicators 14 are fixed relative to the upper portion U and cooperate with each other to indicate whether the upper portion U is level. The load-bearing assembly 12 includes a plurality of support jacks 16 that support the upper portion U on the lower portion L. The support jacks 16 are spaced apart from one another. For example, as is shown in FIG. 7, the support jacks 16 may be located at each corner of the foundation walls FW and also near the middle of longer foundation walls FW as necessary. The support jacks 16 are individually (i.e. independently) and vertically adjustable so as to enable maintenance of the upper portion U in a level condition. As illustrated in FIG. 4, the preferred support jacks 16 have a threaded rod with reverse threads on each end, i.e. right hand threads on one end 62 and left hand threads on the other end 64 which provide twice the vertical movement per revolution of the rod as compared to a conventional threaded rod having only one end threaded. While this is the preferred type of jack for this embodiment, other types of support jacks 16 can be substituted without deviating from the scope of the invention. As will be appreciated, threaded rod 60 is turned or rotated by turning it with a wrench (not shown) about its adjusting nut 66 which is rigidly fixed to, preferably integral with, rod 60.

Referring now more specifically to FIGS. 2–6, there is shown a first embodiment of the load-bearing assembly 12 of the system 10 of the present invention. In addition to support jacks 16, load-bearing assembly 12 includes rigidifying means, generally designated by the numeral 18, for minimizing sagging of the upper portion U between the support jacks 16. Rigidifying means 18 comprises an I-beam 20 disposed between each load-bearing wall UW of the upper portion U and a corresponding foundation wall FW of the lower portion L. The I-beam 20 has a web portion 20A that extends between an upper flange portion 20B and a lower flange portion 20C. The I-beam 20 extends longitudinally along the length of the load-bearing wall UW. The I-beam 20 takes the place of the rim joist and sill combination (not shown in FIGS. 2–6) that customarily underlies the load-bearing wall UW in a typical residential building structure B. For this reason, system 10 including the first embodiment of the load-bearing assembly is best suited for use in a new building structure B because it is more easily installed during the original construction of the building structure B. However, a system 10 including the first embodiment of the load-bearing assembly 12 is not restricted to new construction and may be incorporated into existing building structures B.

FIGS. 2–6 only show a single I-beam 20 and a single support jack 16, but it will be appreciated that in this first embodiment of the load-bearing assembly 12 an I-beam 20 is disposed between each load-bearing wall UW and corresponding foundation wall FW and that the support jacks 16 rest on upper ends of the foundation walls FW and are spaced apart as shown in FIG. 7 so that a separate support jack 16 is disposed at opposite ends of each I-beam 20. As also shown, each support jack 16 is received through an opening 22 formed in the lower flange portion 20C of the I-beam 20 and extends upwardly through the opening 22 and is in contact with the underside of the upper flange portion 20B in order to apply upward force to the I-beam 20.

Figure 5:
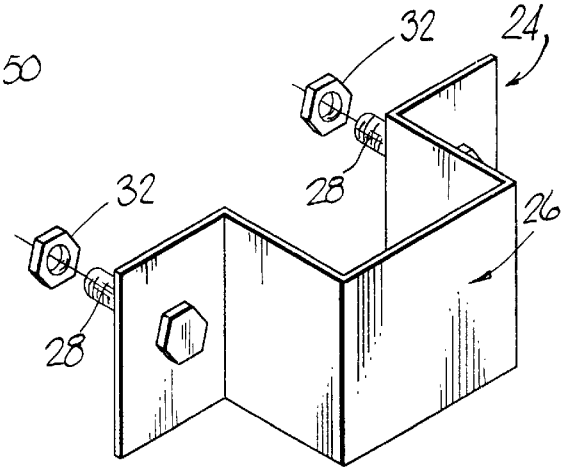
FIG. 5 is a perspective view of the U-shaped bracket of FIG. 4.
Figure 6:
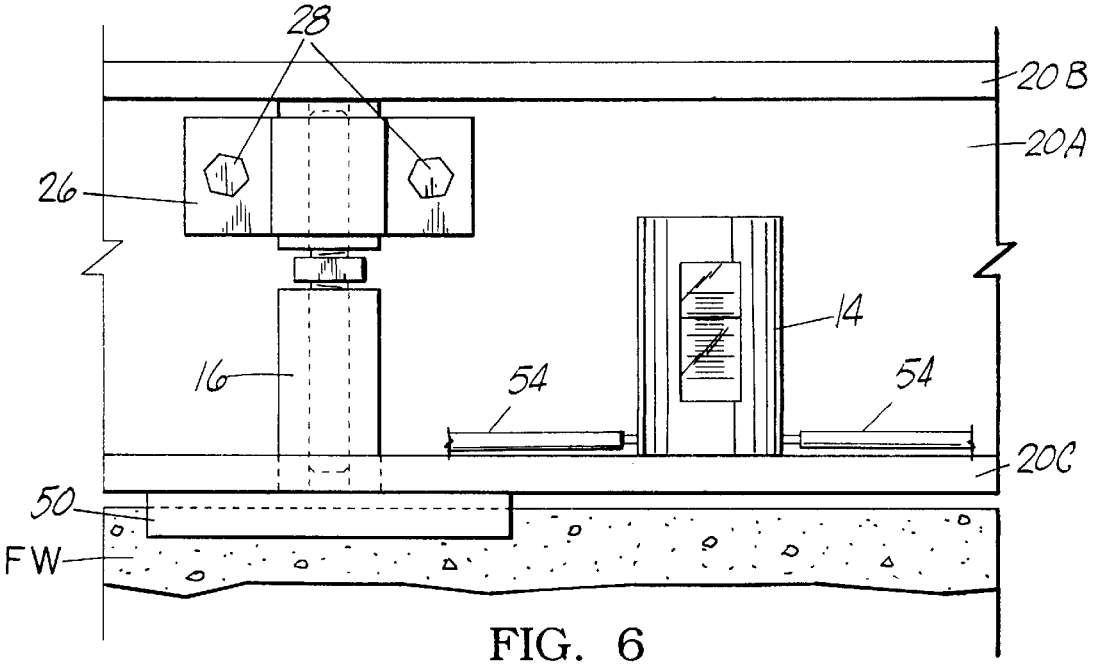
FIG. 6 is side plan view showing the first embodiment of the loading bearing assembly shown in FIG. 4 and also showing an indicator and flow line means of the system of the present invention.

As shown in FIGS. 4–6, the first embodiment of the load-bearing assembly 12 also includes means, generally designated 24, for restricting lateral movement of each support jack 16. The means 24 for restricting lateral movement of each support jack 16 includes a U-shaped bracket 26 that is fastened to the web portion 20A of the I-beam 20 to which the support jack 16 applies upward force. The U-shaped bracket 26 is fastened to the web portion 20A by a pair of bolts 28 received through a pair of openings 30 in the web portion 20A and a pair of nuts 32 threadably engaged with the bolts 28. The U-shaped bracket 26 and the web portion 20A of the I-beam 20 define an opening 34 for receiving the support jack 16 so that the support jack 16 extends upwardly through the opening 34 thereby restricting lateral movement of the support jack 16.

Figure 9:
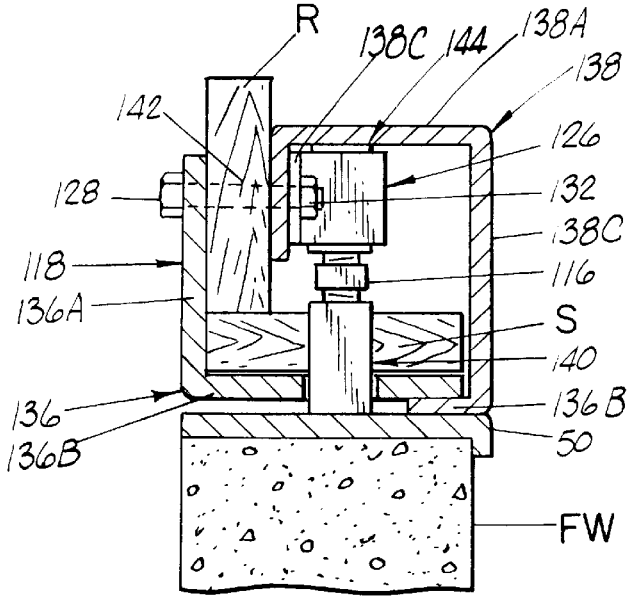
FIG. 9 is a fragmentary view taken in vertical cross-section of a foundation wall of a building structure showing a second embodiment of a load-bearing assembly of the system of the present invention.

FIG. 9 illustrates a second embodiment of a load-bearing assembly 112 for system 10 of the present invention. In addition to support jacks 116, load-bearing assembly 112 further includes rigidifying means, generally designated 118, for minimizing sagging of the upper portion U between the support jacks 116. Rigidifying means 118 minimizes sagging of the upper portion by rigidifying the rim joist R and sill S combination that customarily underlie each load-bearing wall UW of the upper portion U. Each rim joist R and sill S combination is rigidified by means of a cross-sectionally L-shaped angle member 136. One or more G-shaped saddle members 138 comprising rigid interconnection means transmit upward force from one or more support jacks 116 to the L-shaped angle member 136. Load-bearing assembly 112 is best suited for use in an existing building structure B because it does not require removal of existing rim joists R and sills S. However, load-bearing assembly's 112 use is certainly not restricted to existing structures and may also be incorporated into the construction of a new building structure B.

Although FIG. 9 only shows a single rim joist R and sill S combination rigidified by a single L-shaped angle member 136 and a single G-shaped saddle member 38 transmitting upward force from a single support jack 116, it will be appreciated that there are a plurality of L-shaped angle members 136, each rigidifying a separate rim joist R and sill S combination, and the support jacks 116 rest on upper ends of the foundation walls FW and are spaced apart as shown in FIG. 7 so that a support jack 116 is preferably disposed at opposite ends of each L-shaped angle member 136. As shown, L-shaped angle member 136 includes a vertical portion 136A that is fastened to the exterior surface of the rim joist R and a horizontal portion that extends underneath the corresponding sill S. The L-shaped angle member 136 extends longitudinally along the length of the rim joist R and sill S combination. The G-shaped saddle member 138 has upper and lower horizontal portions 138A, 138B and inner and outer vertical portions 138C, 138D. The lower horizontal portion 128B extends underneath and overlaps the horizontal portion 136B of the L-shaped angle member 136. The inner vertical portion 138C extends between and connects the upper and lower horizontal portions 138A, 138B. The outer vertical portion 138D extends downward from the upper horizontal portion 138A and is fastened to the interior surface of the rim joist R to which the vertical portion 136A of the L-shaped angle member 136 is fastened. The sill S and the horizontal portion of the L-shaped angle member 136 have a pair of aligned openings 140 formed therethrough for receiving support jack 116 so that the support jack 116 extends upwardly through the pair of aligned openings 140 and is in contact with the underside of the upper horizontal portion 138A of the G-shaped saddle member 138 in order to apply upward force to the G-shaped saddle member 138 which is in turn transmitted by the G-shaped saddle member 138 to the L-shaped angle member 136.

Load-bearing assembly 112 also includes means, generally designated 124, for restricting lateral movement of each support jack 116. The means 124 for restricting lateral movement of each support jack 116 includes a U-shaped bracket 126 (as shown as bracket 26 in FIG. 5) that is fastened to the to the outer vertical portion 138D of the G-shaped saddle member 138 to which the support jack 116 applies upward force. The U-shaped bracket 126 is fastened to the outer vertical portion 138D by a pair of bolts 128 received through a pair of openings 142 defined through the combination of the outer vertical portion 138D, the rim joist R and the vertical portion 136A of the L-shaped angle member 136 and a pair of nuts 132 threadably engaged with the bolts 128. The U-shaped bracket 126 and the outer vertical portion 138D of said G-shaped saddle member 138 define an opening 144 for receiving the support jack 116 so that the support jack 116 extends upwardly through the opening 144 thereby restricting lateral movement of the support jack 116.

It should be appreciated that the rigidifying means 18, 118 specified above in the first and second embodiments of the load-bearing assembly 12 may be used in combination with each other in a single system 10 of the present invention. Furthermore, more than one I-beam 20 can be disposed end-to-end under a single load-bearing wall UW or more that one L-shaped angle member 136 can be used to rigidify a single rim joist R and sill S combination if necessary.

Figure 10:
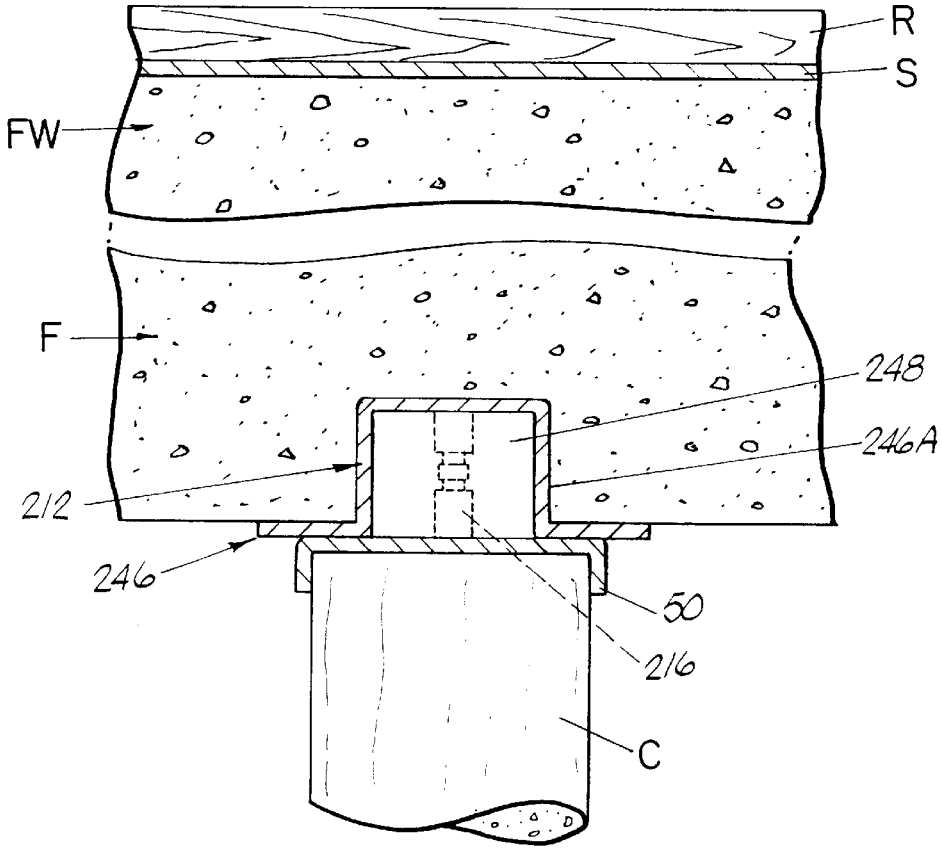
FIG. 10 is fragmentary view taken in longitudinal cross-section of a foundation wall of a building structure showing a third embodiment of a load-bearing assembly of the system of the present invention.

Referring now to FIG. 10, the foundation F may be supported upon a plurality of caissons C. In this situation, the foundation F is considered to be part of the upper portion U of the building structure B. The caissons C comprise the lower portion L of the building structure B. A third embodiment of a load-bearing assembly of the present invention designated by numeral 212 is designed for use in this situation. In addition to support jacks 216, load bearing assembly 212 further includes a plurality of block-out plates 246. Each block-out plate 246 is aligned over a caisson C and includes an upright section 246A extending upwardly into and forming a hollow space 248 in the foundation F. A support jack 216 is disposed within each hollow space 248. The plurality of support jacks 216 disposed in the hollow spaces 248 support the foundation F of the upper portion U upon the caissons C of the lower portion L. The support jacks 216 also apply upward force to the foundation F and are adjustable to enable one to maintain the upper portion U in a level condition. Preferably, support jacks 216 are of a hydraulic type so that they may be adjusted without direct accessing the hollow spaces 248. However, means (not shown) for accessing the hollow spaces 248 can be built into the foundation F so that other types of support jacks 216 are also suitable.

Referring now to FIGS. 2–6, 9 and 10, it is shown that the previously described first, second and third load-bearing assemblies 12, 112 and 212 all include pressure disbursement plates 50 that overly the lower portion L and support the support jacks 16, 116 and 216 thereon so as to disburse downward force transmitted by the support jacks over a larger area of the lower portion L. In the first and second embodiments, the pressure disbursement plates 50 overly the foundation walls FW. In the third embodiment, the pressure disbursement plates 50 overly the caissons C.

Figure 1:
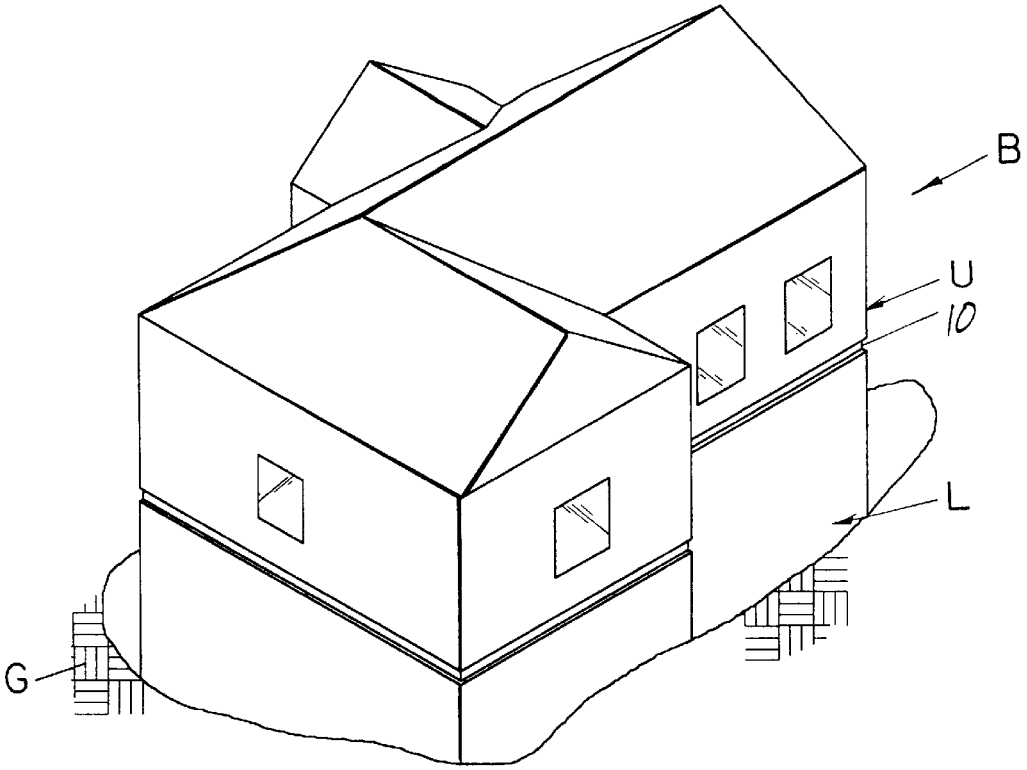
FIG. 1 is a perspective view of a building structure incorporating a system of the present invention.
Figure 2:
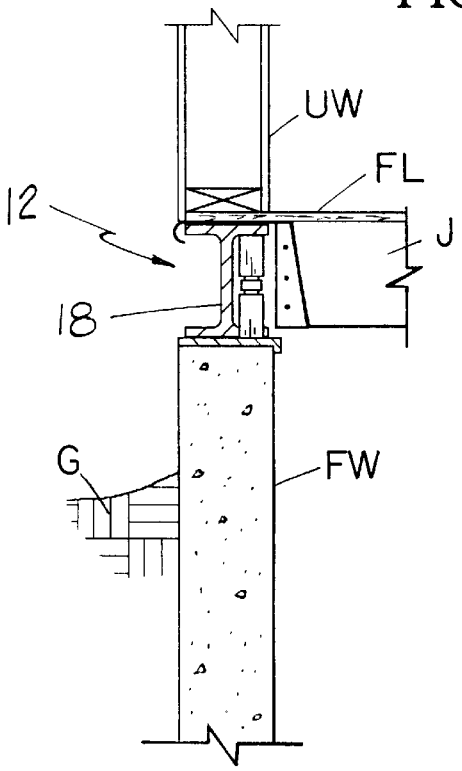
FIG. 2 is a fragmentary view taken in vertical cross-section of a load-bearing wall and corresponding foundation wall of a building structure showing a first embodiment of a load-bearing assembly of the system of the present invention.
Figure 3:
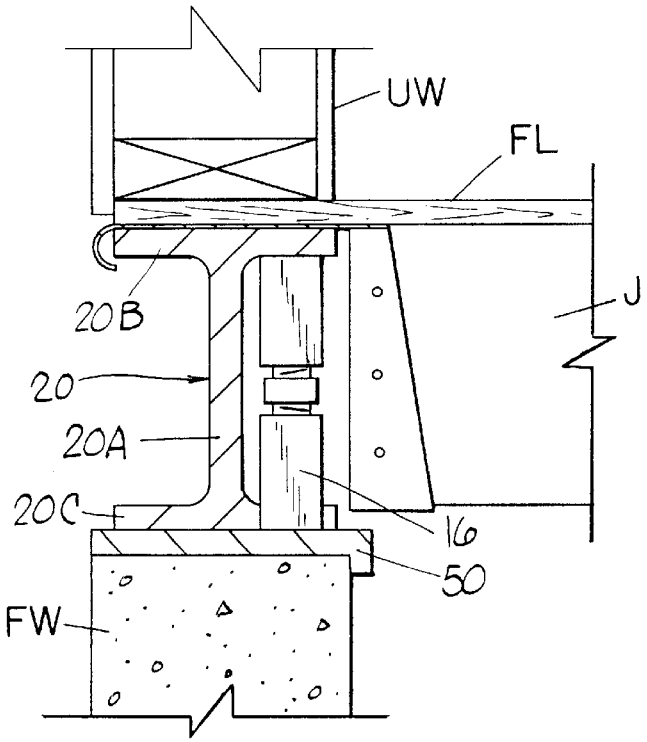
FIG. 3 is an enlarged and more detailed view of FIG. 2.
Figure 8:
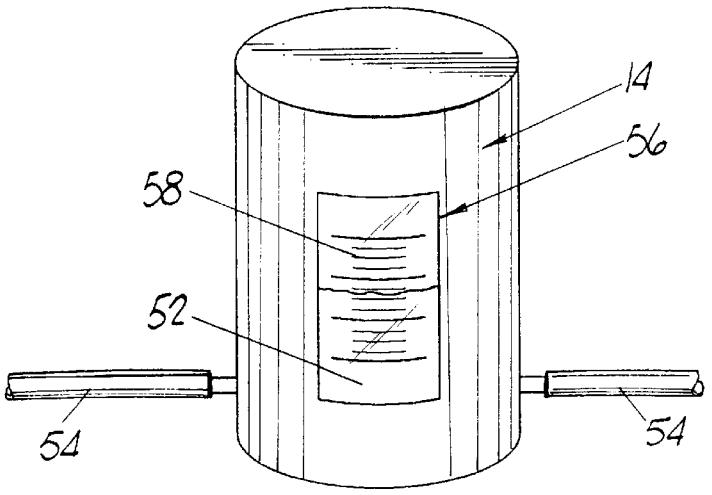
FIG. 8 is a perspective view showing an indicator and flow line means of the system of the present invention.

Referring now to FIG. 8, there is shown an embodiment of the indicators 14 of system 10 of the present invention. As shown, indicators 14 have a fluid 52 such as water disposed therein and are interconnected by flow line means 54 to form a system wherein the fluid 52 flows within the system so that indicators 14 cooperate with each other to indicate whether the upper portion U is level. The indicators 14 may be interconnected in a series fashion as is shown in FIG. 7 or in another fashion such as a hub and spoke arrangement (not shown). Each indicator 14 includes a transparent window 56 so that the level of fluid 52 within the indicator 14 can be observed. A scale 58 is also provided on transparent window 56 so that the level of fluid 52 in each indicator 14 can be measured. The indicators 14 are preferably fixed relative to the upper portion U so that the upper portion U is level when the measured level of fluid 52 in all of the indicators 14 is the same. The indicators 14 may be fixed directly on the upper portion U. For example, in a system 10 including either the second or third embodiments of the load-bearing assembly 12 as shown in FIGS. 9 and 10, the indicators 14 are fixed to the rim joists. The indicators 14 may also be fixed to a portion of the load-bearing assembly that is fixed relative to the upper portion U. For example, in a system 10 utilizing load-bearing assembly 12 as shown in FIGS. 2–4, indicators 14 are fixed to the I-beams 20.

In addition to indicating whether the upper portion U is level, the embodiment of the indicators 14 shown also cooperatively indicate the degree to which the upper portion U is tilted with respect to a level condition when the upper portion U is out of level. When the upper portion U tilts, fluid flows between the indicators 14 so that the level of fluid in each of the indicators 14 is not the same. The differences between the level of fluid 52 in the indicators 14 cooperatively indicates the degree to which the upper portion is tilted. Although it is not necessary in order to practice the present invention, each indicator 14 may be associated with a separate support jack 16 and the scale 58 on the transparent window 56 of each indicator 14 can be calibrated in order to determine the amount to vertically adjust the support jack 16 associated with each indicator 14 in order to bring the upper portion U to a level condition.

With the system 10 of the present invention incorporated into the building structure B, the upper portion U can be maintained in a level condition by periodically observing the indicators 14 in order to determine whether the upper portion U is level and manually adjusting the height of the support jacks 16 as needed until the indicators 14 indicate that the upper portion is level. Alternatively, the system 10 can include control means (not shown) for automatically adjusting the vertical height of the support jacks 16 in response to input from the indicators 14 so that the upper portion U is maintained in a level condition at all times.

The present invention also contemplates a method of keeping an upper portion U of a building structure B level. The method involves installing one of the above-described vertically adjustable load-bearing assemblies 12, 112 or 212 in the building structure B so that spaced support jacks such as jacks 16, 116 or 216 support the upper portion U of the building structure above the lower portion L thereof. Each support jack is individually and vertically adjustable. The method also involves fixing a plurality of the above-described level indicators 14 relative to the upper portion U so that the indicators 14 cooperate with each other to indicate whether the upper portion U is level. After a load-bearing assembly(s) has been installed and the indicators 14 have been fixed relative to the upper portion U, the height of the support jacks is adjusted until the indicators 14 indicate that the upper portion U is level.

The method of the present invention also preferably includes the further step of rigidifying the load-bearing assembly(s) to minimize sagging of the upper portion between the support jacks. This may be accomplished by installing or including the above-described I-beams 20 or the above-described L-shaped angle members 136 and G-shaped saddle members 138 in the load-bearing assembly (s).

The method of the present invention further contemplates periodically checking the indicators 14 to determine whether the upper portion U is level and adjusting the height of the support jacks manually as needed to keep the upper portion U level. Alternatively, the method may include the step of automatically adjusting the height of the support jacks by means of a controller responsive to input from the indicators 14 to maintain the upper portion U in a level condition.

It is believed that the present invention and its advantages will be understood from the foregoing description and it will be apparent that various changes may be made thereto without departing from the spirit and scope of the invention or sacrificing all of its material advantages, the form hereinbefore described being merely a preferred or exemplary embodiment thereof.

I claim:

1. A system for maintaining an upper portion of a building structure overlying a lower portion in a level condition, comprising:

(a) a vertically adjustable load-bearing assembly for supporting the upper portion of the building structure above the lower portion, said load-bearing assembly including a plurality of support jacks supporting the upper portion above the lower portion, each said support jack being spaced apart from the others and being adjustable vertically in height independent of the other in order to maintain the upper portion in a level condition, said load-bearing assembly further including rigidifying means including an I-beam having a web portion extending between upper and lower flange portions, said I-beam being disposed between a load-bearing wall of the upper portion and a corresponding foundation wall of the lower portion and extending longitudinally along the length of the load-bearing wall, said support jacks resting on the upper end of the foundation wall of the lower portion and said I-beam having at least one opening formed through the lower flange portion thereof for receiving a support jack so that one said support jack extends upwardly through said opening and is in contact with the underside of the upper flange portion of said I-beam in order to apply upward force to said I-beam; and (b) a plurality of level indicators fixed relative to the upper portion for cooperating with each other to indicate whether the upper portion is level.

2. The system of claim 1 wherein lateral movement of said one support jack is restricted by means of a U-shaped bracket fastened to the web portion of said I-beam to form an opening defined by said U-shaped bracket and the web portion of said I-beam for receiving said one support jack.

3. A system for maintaining an upper portion of a building structure overlying a lower portion in a level condition wherein the upper portion of the building structure has a rim joist and sill combination underlying exterior walls thereof, said system comprising:

(a) a vertically adjustable load-bearing assembly for supporting the upper portion of the building structure above the lower portion, said load-bearing assembly including a plurality of support jacks supporting the upper portion above the lower portion, each said support jack being spaced apart from the others and being adjustable vertically in height independent of the other in order to maintain the upper portion in a level condition, said load-bearing assembly further including rigidifying means including:

(i) at least one cross-sectionally L-shaped angle member, said angle member having a vertical portion fastened to the exterior surface of a rim joist of a rim joist and sill combination and a horizontal portion extending underneath the corresponding sill, said angle member extending longitudinally along the length of the rim joist and sill combination; and (ii) rigid interconnection means for transmitting upward force from at least one of said support jacks to said L-shaped angle member; and (b) a plurality of level indicators fixed relative to the upper portion for cooperating with each other to indicate whether the upper portion is level.

4. The system of claim 3 wherein said rigid interconnection means comprises a cross-sectionally G-shaped saddle member, said saddle member having upper and lower horizontal portions and inner and outer vertical portions, the lower horizontal portion extending underneath and overlapping the horizontal portion of said L-shaped angle member, the inner vertical portion extending between and connecting the upper and lower horizontal portions, and the outer vertical portion extending downward from the upper horizontal portion and being fastened to the interior surface of the rim joist to which the vertical portion of said L-shaped angle member is fastened.

5. The system of claim 3 wherein said support jacks rest on the lower portion, the sill and the horizontal portion of said L-shaped angle member each have at least one aligned opening formed therethrough for receiving at least one said support jack so that one said support jack extends upwardly through each said pair of aligned openings and is in contact with the underside of the upper horizontal portion of said G-shaped saddle member in order to apply upward force to said G-shaped saddle member.

6. The system of claim 5 wherein lateral movement of one said support jack is restricted by means of a U-shaped bracket fastened to the outer vertical portion of one said G-shaped saddle member, said U-shaped bracket and the outer vertical portion of said G-shaped saddle member defining an opening for receiving said one said support jack.

7. A system for maintaining an upper portion of a building structure overlying a lower portion in a level condition wherein the lower portion comprises a plurality of caissons and the upper portion includes a foundation, said system comprising:

(a) a vertically adjustable load-bearing assembly for supporting the upper portion of the building structure above the lower portion, said load-bearing assembly including a plurality of support jacks supporting the upper portion above the lower portion, each said support jack being spaced apart from the others and being adjustable vertically in height independent of the other in order to maintain the upper portion in a level condition, said load-bearing assembly further including a plurality of block-out plates, each said block-out plate being aligned over a caisson and including an upright section extending upwardly into and forming a hollow space in the foundation with one of said support jacks disposed therein such that said plurality of support jacks support the foundation of the upper portion upon the caissons of the lower portion; and (b) a plurality of level indicators fixed relative to the upper portion for cooperating with each other to indicate whether the upper portion is level.

8. A system for maintaining an upper portion of a building structure overlying a lower portion in a level condition, comprising:

(a) a vertically adjustable load-bearing assembly for supporting the upper portion of the building structure above the lower portion, said load-bearing assembly including a plurality of support jacks supporting the upper portion above the lower portion, each said support jack being spaced apart from the others and being adjustable vertically in height independent of the other in order to maintain the upper portion in a level condition; and (b) a plurality of level indicators fixed relative to the upper portion for cooperating with each other to indicate whether the upper portion is level, said indicators having fluid disposed therein, and flow line means interconnecting said indicators to form a system wherein said fluid flows within said system so that the amount of fluid within said indicators cooperatively indicates whether the upper portion is level, said indicators further comprising:

(i) at least one transparent window on a vertical side of each said indicator through which the level of said fluid within each said indicator may be observed; and (ii) a scale displayed on each said transparent window for measuring the level of said fluid in each said indicator, said indicators providing an indication that the upper portion is level when the measured level of said fluid in all said indicators is the same.

9. The system of claim 8 wherein each said indicator is associated with a separate one of said support jacks and said scale is calibrated in order to determine the amount to vertically adjust said support jack associated with each said indicator in order to bring the upper portion of the building structure to a level condition.

* * * * *